US011953302B2

(12) United States Patent
Murchison

(10) Patent No.: US 11,953,302 B2
(45) Date of Patent: Apr. 9, 2024

(54) CARTRIDGE CASE AND PROJECTILE

(71) Applicant: David Murchison, Amarillo, TX (US)

(72) Inventor: David Murchison, Amarillo, TX (US)

( * ) Notice: Subject to any disclaimer, the term of this patent is extended or adjusted under 35 U.S.C. 154(b) by 0 days.

(21) Appl. No.: 17/484,035

(22) Filed: Sep. 24, 2021

(65) Prior Publication Data

US 2023/0103234 A1 Mar. 30, 2023

(51) Int. Cl.
*F42B 5/02* (2006.01)
*F42B 12/74* (2006.01)

(52) U.S. Cl.
CPC ..... *F42B 5/025* (2013.01); *F42B 12/74* (2013.01)

(58) Field of Classification Search
CPC .. F42B 5/025; F42B 5/02; F42B 12/74; F42B 12/76; F42B 12/78
See application file for complete search history.

(56) References Cited

U.S. PATENT DOCUMENTS 8,443,729 B2 5/2013 Mittelstaedt
8,448,575 B2 5/2013 Goddard
8,875,432 B2 11/2014 Goddard
10,955,228 B2 3/2021 Kedairy
11,333,472 B1 * 5/2022 Peterson ..... F42B 12/74
2011/0214583 A1 * 9/2011 Dutch ..... F42B 5/26 102/464
2016/0290774 A1 * 10/2016 Langenbeck ..... F42B 30/02
2017/0276463 A1 9/2017 Tubb et al.
2018/0209768 A1 * 7/2018 Peterson ..... F42B 5/067
2019/0011232 A1 * 1/2019 Boss ..... F42C 19/0823
2019/0011233 A1 * 1/2019 Boss ..... F42C 19/0823
2019/0011234 A1 * 1/2019 Boss ..... C22C 38/42
2019/0204051 A1 7/2019 Franklin et al.
2020/0326168 A1 * 10/2020 Boss ..... B22F 5/06

FOREIGN PATENT DOCUMENTS

DE 102004036148 A1 * 2/2006 ..... F42B 12/06

* cited by examiner

*Primary Examiner* — Jonathan C Weber
(74) *Attorney, Agent, or Firm* — Edison Law Group

(57) ABSTRACT

A cartridge case and projectile combination having a maximum length of 1.6". The cartridge case to receive a projectile has a rebated rim of a 0.535" diameter, body length from web to shoulder of 0.7003", a case shoulder angle of 42°, a longitudinal distance between said shoulder and neck of 0.1557", a case neck length of 0.229", a mouth. The cartridge case has a total case length of 1.285". The projectile includes a front section having a length of 0.315" that extends past said cartridge case and a back section from the front section to a base of the projectile that fits inside of the case at the mouth.

5 Claims, 4 Drawing Sheets

CARTRIDGE CASE AND PROJECTILE

BACKGROUND

The present invention generally relates to ammunition. More specifically, the present invention relates to a new cartridge case and projectile combination.

Military and police personnel are firearm users. These users have generally used at least two firearms for different tactical situations requiring different ammunition for each firearm. The first is a rifle chambered in 5.56×45 NATO and the second is a pistol chambered for 9 mm. Because this requires two types of ammunition which are not interchangeable, the user must decide which amount of each ammunition type the user will carry into a tactical situation. If the user chooses the wrong amount of ammunition type, then there might not be enough ammunition for the situationally required firearm, thus forcing use of a less useful firearm for the tactical situation at hand. Not knowing what situations might arise, which firearm will be most effective, and which ammunition would be most used, then it behooves the user to have ammunition which will work in either firearm. The 5.56 round is too long to fit in a conventional semiautomatic pistol, as the pistol grip holding the magazine would be too large for the majority of hands of the users. There are AR-style pistols which are essentially a standard AR with a shorter barrel and a brace replacing the butt stock. This style of pistol cannot easily be carried in a holster like most pistols referred to as handguns. The 9 mm round of ammunition is considered by many to have insufficient stopping power and would therefore not be an adequate rifle round, especially for shooting long distances. Providing a single cartridge which could be effectively fired in a pistol and a rifle using interchangeable magazines would allow greater flexibility to the user for the given tactical situation without being forced to use an inappropriate firearm because all of the required ammunition had been expended. So what is needed is ammunition that retains the shooting distance of a rifle, while able to function in a handgun by having the ability to use magazines interchangeably between the rifle and handgun.

It is an object of the present invention to provide ammunition that retains the shooting distance of a rifle, while able to function in a handgun.

SUMMARY

A cartridge case and projectile combination having a maximum length of 1.6". The cartridge case to receive a projectile has a rebated rim of a 0.535" diameter, a body length from web to shoulder of 0.7003", a case shoulder angle of 42°, a longitudinal distance between said shoulder and neck of 0.1557", a case neck length of 0.229", a mouth. The cartridge case has a total case length of 1.285". The projectile includes a front section having a length of 0.315" that extends past said cartridge case and a back section from the front section to a base of the projectile that fits inside of the case at the mouth.

DETAILED DESCRIPTION

Figure 1:
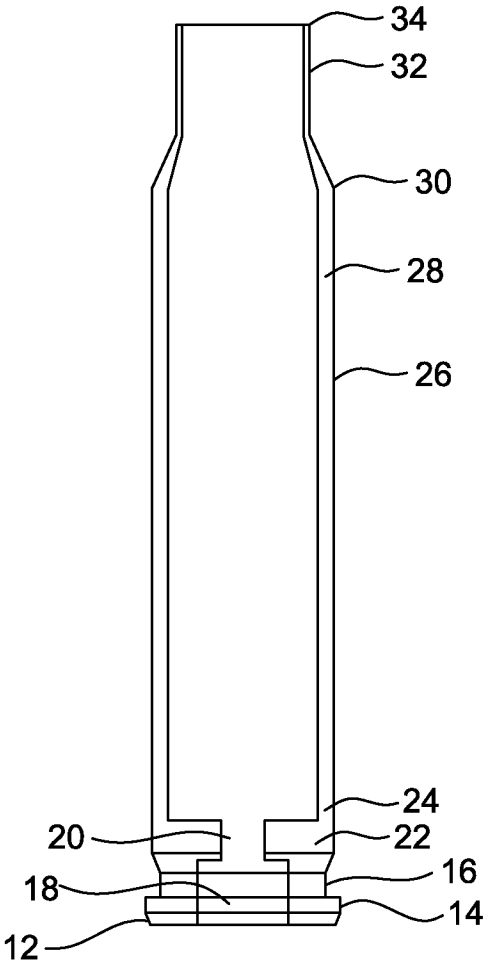
FIG. 1 is a schematic cutaway view of a cartridge case.
Figure 2:
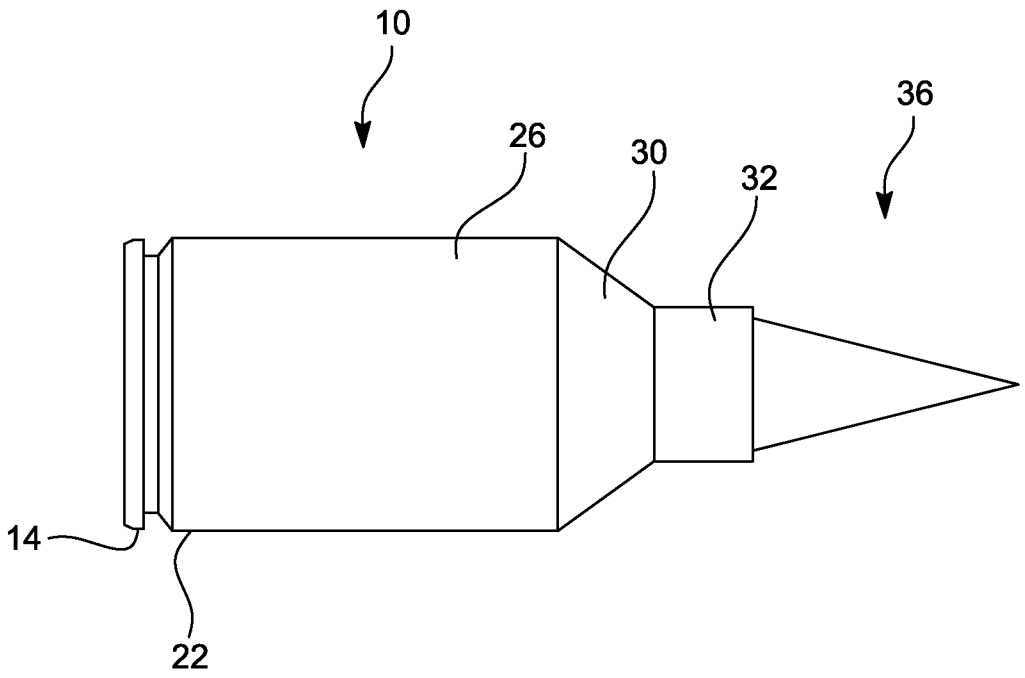
FIG. 2 is a dimensional side view of a cartridge case and projectile according to the present invention.

A cartridge case and projectile (bullet) combination designed to be used in a properly chambered rifle or handgun. FIG. 1. schematically illustrates the features of a cartridge case to use as a reference guide for FIG. 2 and FIG. 2 is a schematic dimensional drawing of the cartridge and projectile combination which includes dimensions. The dimensions in FIG. 2 are in inches with the metric equivalent in parentheses. A plus or minus sign indicates an allowable tolerance range. Based on the design of the present invention, the cartridge and projectile can be loaded into magazines that can be inserted into both a rifle and semi-auto handgun. The starting point for the cartridge is a projectile which is the projectile size of one of the military's standard rifle cartridges, the 5.56, and the civilian version, 223. The projectile is the metric equivalent of the 5.56/223 grove diameter. Using the Sporting Arms and Ammunition Manufacturers' Institute, Inc. (SAAMI) specifications, the rifle and pistol would have barrels with groves diameters measuring 0.2245" and with a bore diameter of approximately 0.219". The ability for the projectile of a caliber of 5.56/223 to function both in rifles and normal sized handguns limits the cartridge and projectile combination to 1.6" in length. The length limitation of 1.6" for the cartridge and projectile combination in a handgun magazine allows the pistol grip that receives the handgun magazine to be small enough for most adults to adequately grip the pistol grip of a handgun in one hand. In order to provide sufficient energy to propel the projectile fired from the rifle, the cartridge case is shorter and larger in diameter than the normal 5.56 case to allow for the proper amount of propellant in the case to move the projectile effectively.

FIG. 1 shows a case 10 with a base 12, rim 14, extractor groove 16, primer pocket 18, flash hole 20, web 22, head 24, body 26, wall 28, shoulder 30, neck 32 and mouth 34, which are standardized terms for components of a cartridge case. The mouth 34 is an opening at the top of the neck 32 to receive propellant and a projectile. In FIG. 2, the letter B next to a dimension denotes a required measurement for proper head spacing of the case 10 in a firearm. FIG. 2 shows the case 10 includes a rebated rim 14 that has a 0.535" diameter. The outside diameter of the web 22 is 0.5550", where the diameter of the body 26 tapers from the head 24 at the 0.5550" diameter to a diameter of 0.5444" where the body 26 and the shoulder 30 meet. The diameter of 0.5444" is a required reference diameter for the case 10 to fit in a chamber of a firearm. The diameter of the body 26 between where the body 26 and the shoulder 30 meet and the head 24 can vary by a −0.008". The case 10 has body 26 length, from the head 24 to the shoulder 30, of 0.7003" and shoulder angle of 42° to reduce the longitudinal distance between the shoulder 30 and neck 32, which is 0.1557". The case 10 has a neck length of 0.229". This establishes a case length of 1.285" which limits the portion of the projectile protruding from the case 10 to only 0.315" in order to stay within the 1.6" total length.

Armor piercing (AP) projectiles, as with the standard military 5.56 AP projectile with a steel core, are too long and take up too much of the case volume when limiting the protruding portion of the projectile to 0.315" to maintain the 1.6" total length. Whereby, the non-protruding portion of AP projectile will be pushed well into the case 10 and with the ogive of the projectile beginning inside the neck, thereby reducing the acceptable frictional area of the projectile. The length of the internal portion and overall shape of the projectile depends on the weight of the projectile. Consequently, a shorter projectile with the same or greater weight is required. In order to achieve an adequate weight to pierce armor, a new core material for the projectile is required. Tungsten carbide (W2C) was chosen as a new material due to its greater density and hardness over a steel core. These two properties would allow the design of an AP projectile 36 of FIG. 2 to be shorter and heavier than the standard military 5.56 AP projectile. The overall length limits the overall projectile length to 0.7855", so depending on the weight of the W2C core, the length of the projectile 36 and projectile shape could vary slightly to a maximum length of 0.7855".

Figure 3:
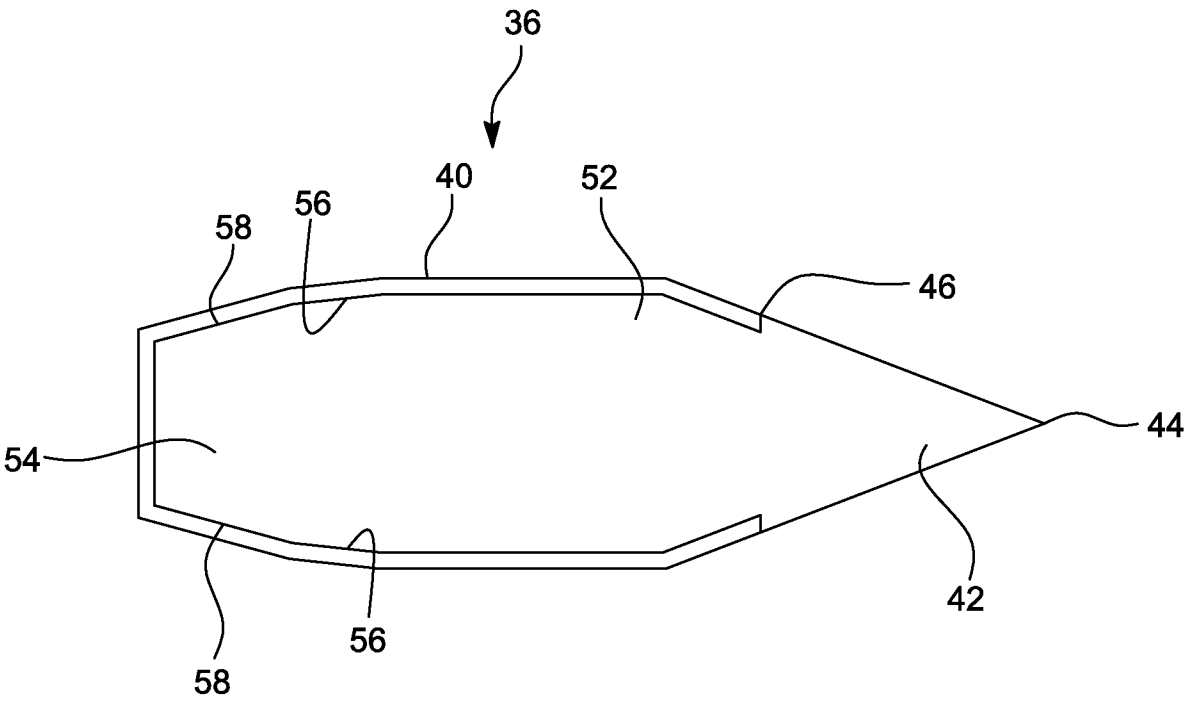
FIG. 3 is a dimensional side view of a projectile according to the present invention.
Figure 4:
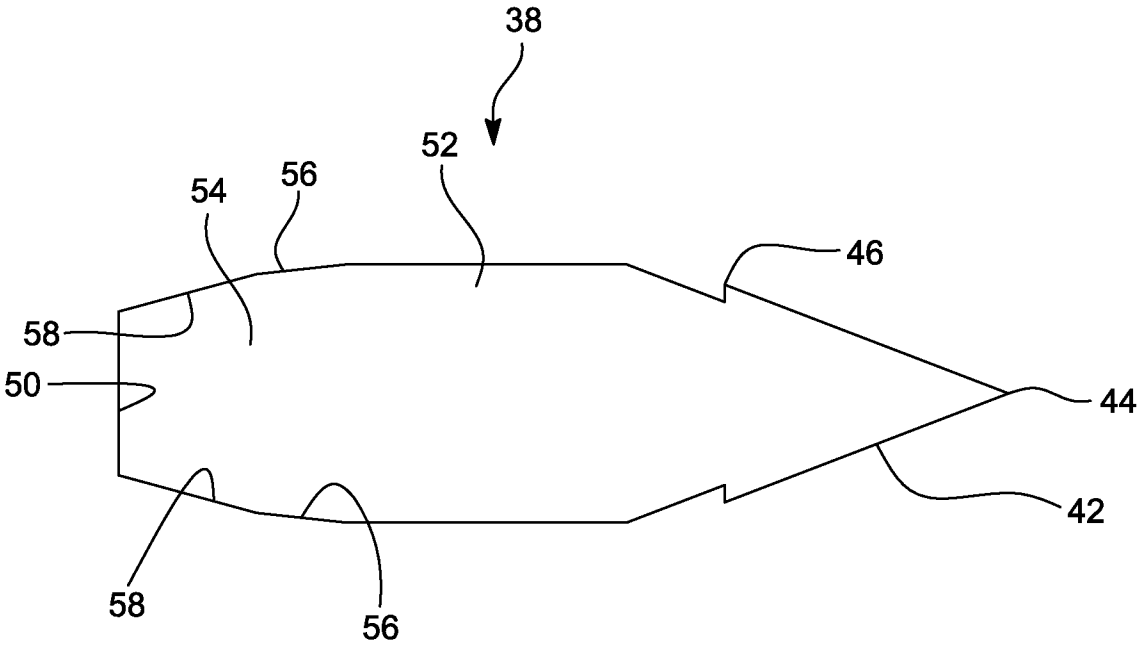
FIG. 4 is a dimensional side view of a projectile core according to the present invention.

FIG. 3 shows the projectile 36 with a W2C core 38 that is partially covered by an outside layer 40 referred to as a jacket. The outside layer 40 is typically made of copper or brass, although other coatings could be used. FIG. 4 shows the core 38 without the outside layer 40. Both FIGS. 3 and 4 show dimensions in inches and any allowed tolerances. The front section 42 of the projectile 36 is kept at a maximum length of 0.315", with the tip 44 of the front section 42 being cone shaped out to a barb 46. The barb 46 establishes the junction area of the core 38 and the outside layer 40. The outside layer 40 continues from the junction area to the base 48 and back end 50 of the projectile 36 with a thickness of 0.020" of material all around the core 38. The diameter of the core 38 at the barb 46 is 0.1660" to keep the exposed section of the core 38 below the diameter of the barrel bore to be used and to prevent the core 38 from eroding the barrel lands. From the base of the barb 46, the diameter of the core 38 increases from 0.126" to 0.1845" over a length of 0.0825". The outside layer 40 fills in this area blending with the barb 46, while maintaining the 19.61° angle, reaching a diameter of 0.2245" at 0.315" from the core tip 44. At 0.315" from the core tip 44, the main body 52 of the core 38 flattens to a constant diameter of 0.1845" for a length of 0.229". The outside layer 40 over the core 38 is still 0.020" thick, maintaining the 0.2245" overall diameter of the projectile 36 and thereby providing adequate fiction holding area. The core 38 transitions from the main body 52 to a two-angled boattail 54 that forms a first segment 56 and a second segment 58. The remainder of the core 36 and boattail 54, can change in length depending on the weight of the core, where a heavier core may require a shortened boattail. The first segment 56 is 0.1135" long where the core 36 goes from a 0.1845" diameter to a 0.1682" diameter. The outside layer 40 continues to follow the core shape along the first segment 56 with a 0.020" thickness. The second segment 58 is 0.108" in length tapering down to a 0.08" diameter from the previous 0.1682" diameter at the first segment 56. The 0.020" outside layer 40 continues to cover the second segment 58 of the core 38 including the flat back end 50 of the core 38. The tolerance for the dimensions is a −0.0030" and all of the transitions of diameters are a constant defined by the amount of diameter change over the transition length.

While different embodiments of the invention have been described in detail herein, it will be appreciated by those skilled in the art that various modifications and alternatives to the embodiments could be developed in light of the overall teachings of the disclosure. Accordingly, the particular arrangements are illustrative only and are not limiting as to the scope of the invention that is to be given the full breadth of any and all equivalents thereof.

I claim:

1. A cartridge case and projectile combination comprising; a cartridge case to receive a projectile having a rebated rim of a 0.535" diameter, a body length from a web to a shoulder of 0.7003", a case shoulder angle of 42°, a longitudinal distance between said shoulder and neck of 0.1557", a case neck length of 0.229", a mouth at an end of said neck, whereby the total cartridge case has a total case length of 1.285"; a projectile that does extend beyond 0.315" of said cartridge case; said projectile includes a W2C core; said core is partially covered by an outside layer of a different material to form a jacket; said core includes a section with a barb between a front and a rear of said core and wherein said outside layer covers said rear of said core to said barb; said barb establishes a junction area of said core and said outside layer; wherein said outside layer continues from said junction area to a back end and base of said core with a thickness of 0.020" of material all around said core; wherein said core has a diameter of 0.1660 at said barb; wherein at a base of said barb 44 said core has a diameter that increases from 0.126" to 0.1845" over a distance of 0.0825" from said base; wherein said outside layer fills in said junction area blending with said barb to maintain a 19.61° angle; wherein said core and said outside layer have a diameter of 0.2245" at 0.0315" from said tip of said core; wherein at 0.315" from said tip of said core a main body of said core flattens to a constant diameter of 0.1845" for a length of 0.229"; wherein said outside layer over said core 38 maintains an 0.2245" overall diameter of said projectile; and wherein said core transitions from said main body to a two-angled boattail.

2. The cartridge and projectile combination of claim 1, wherein said outside layer is a thickness of 0.020" within a tolerance of a −0.0030".

3. The cartridge and projectile combination of claim 1, wherein a first segment of said boattail is 0.1135" long where said core reduces from a 0.1845" diameter to a 0.1682" diameter and said outside layer continues to cover said core with a 0.020" thickness; and a second segment of said boattail is 0.108" in length tapering down to a 0.08" diameter from said 0.1682" diameter of said first segment and said outside layer continues to cover said core with a 0.020" thickness including a back end of said core.

4. The cartridge and projectile combination of claim 1, wherein a tolerance for dimensions of said core is a −0.0030".

5. The cartridge and projectile combination of claim 3, wherein a tolerance for dimensions of said core is a −0.0030".

* * * * *